US009578996B2

(12) United States Patent
Harris et al.

(10) Patent No.: US 9,578,996 B2
(45) Date of Patent: Feb. 28, 2017

(54) PUMPS WITH ANGLED OUTLETS, REFILL UNITS AND DISPENSERS HAVING ANGLED OUTLETS

(71) Applicant: GOJO Industries, Inc., Akron, OH (US)

(72) Inventors: Donald R. Harris, Tallmadge, OH (US); Robert L. Quinlan, Stow, OH (US); John J. McNulty, Broadview Heights, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 14/595,678

(22) Filed: Jan. 13, 2015

(65) Prior Publication Data

US 2015/0196170 A1 Jul. 16, 2015

Related U.S. Application Data

(60) Provisional application No. 61/927,756, filed on Jan. 15, 2014.

(51) Int. Cl.
*A47K 5/12* (2006.01)
*A47K 5/14* (2006.01)

(52) U.S. Cl.
CPC ..... *A47K 5/1211* (2013.01); *A47K 5/12* (2013.01); *A47K 5/14* (2013.01)

(58) Field of Classification Search
CPC ..... A47K 5/1212; A47K 5/14; A47K 5/12
USPC ..... 222/321.1, 321.7–321.9, 383.1, 383.3
See application file for complete search history.

(56) References Cited

U.S. PATENT DOCUMENTS

| | | | | |
|---|---|---|---|---|
| 585,327 | A | 6/1897 | Guttenberg | |
| 922,453 | A | 5/1909 | Burgner | |
| 1,167,420 | A | 1/1916 | Marcuse | |
| 1,207,278 | A | 12/1916 | Cordley | |
| 1,207,505 | A | 12/1916 | Cordley | |
| 1,220,753 | A | 3/1917 | Kees | |
| 1,553,113 | A | 9/1925 | Rutt | |
| 2,139,735 | A * | 12/1938 | Dobkin | A47K 5/16 222/190 |
| 2,464,030 | A | 3/1949 | Engstrom | |
| 2,529,365 | A | 11/1950 | Barksdale | |
| 2,605,021 | A | 7/1952 | Churchill et al. | |

(Continued)

FOREIGN PATENT DOCUMENTS

| | | | |
|---|---|---|---|
| CH | 676227 | A5 | 12/1990 |
| DE | 202007017965 | U1 | 3/2008 |

(Continued)

OTHER PUBLICATIONS

European Patent Office Search Report issued Jan. 7, 2011 in EP Application No. 09 150 880.2; 4 pages.

(Continued)

*Primary Examiner* — Donnell Long
(74) *Attorney, Agent, or Firm* — Calfee, Halter & Griswold LLP

(57) ABSTRACT

Exemplary pumps, refill units and dispensers having angled outlets are disclosed herein. An exemplary refill unit for dispensing fluid on a hand includes a container and a pump. The pump includes an angled outlet passage. Fluid flowing out of the angled outlet passage is directed toward the palm of a hand when fluid is dispensed.

17 Claims, 3 Drawing Sheets

(56) References Cited

U.S. PATENT DOCUMENTS

| | | | | |
|---|---|---|---|---|
| 2,619,914 | A * | 12/1952 | Dobkin | A47K 5/1204 137/614.16 |
| 2,645,386 | A * | 7/1953 | Bobrick | B67D 7/0205 222/321.9 |
| 2,904,222 | A | 9/1959 | Philippe | |
| 3,200,994 | A | 8/1965 | Levinson et al. | |
| 3,851,801 | A | 12/1974 | Roth | |
| 4,105,146 | A * | 8/1978 | Broillard | G01F 11/025 222/181.2 |
| 4,168,020 | A | 9/1979 | Benson | |
| 4,321,938 | A | 3/1982 | Siller | |
| 4,330,071 | A | 5/1982 | Ohlson | |
| 4,360,130 | A * | 11/1982 | Nishimura | A47K 5/1204 222/153.09 |
| 4,493,440 | A | 1/1985 | von Buelow et al. | |
| 4,793,522 | A | 12/1988 | Corsette | |
| 4,880,161 | A | 11/1989 | Wright | |
| 4,930,667 | A | 6/1990 | Holzner, Sr. | |
| 4,964,544 | A * | 10/1990 | Hanna | A47K 5/1207 137/859 |
| 4,986,453 | A | 1/1991 | Lina et al. | |
| 1,303,708 | A | 5/1991 | Moffitt | |
| 5,033,654 | A | 7/1991 | Bennett | |
| 5,037,006 | A | 8/1991 | Kock | |
| 5,044,900 | A * | 9/1991 | Cavallaro | F04B 19/022 222/383.1 |
| 5,271,530 | A | 12/1993 | Uehira et al. | |
| 5,439,140 | A | 8/1995 | Meyer | |
| 5,445,288 | A | 8/1995 | Banks | |
| 5,462,208 | A | 10/1995 | Stahley et al. | |
| 5,556,005 | A | 9/1996 | Banks | |
| 5,605,256 | A | 2/1997 | Fan | |
| 5,823,397 | A | 10/1998 | Gil | |
| 5,826,755 | A | 10/1998 | Burd | |
| 5,862,954 | A | 1/1999 | Ehrensperger | |
| 5,899,363 | A | 5/1999 | Bliss, III et al. | |
| 5,906,299 | A | 5/1999 | Hagleitner | |
| 5,908,143 | A * | 6/1999 | Crossdale | A47K 5/1204 222/181.3 |
| 6,016,936 | A | 1/2000 | Fan | |
| 6,065,647 | A | 5/2000 | Bliss, III et al. | |
| 6,409,050 | B1 | 6/2002 | Ophardt et al. | |
| 6,446,840 | B2 | 9/2002 | Ophardt et al. | |
| 6,540,111 | B2 | 4/2003 | Sunnarborg | |
| 6,626,332 | B2 | 9/2003 | Ehrensperger et al. | |
| 6,688,499 | B2 | 2/2004 | Zhang | |
| 6,971,549 | B2 | 12/2005 | Leifheit et al. | |
| 6,986,443 | B2 | 1/2006 | Laible | |
| 7,021,494 | B2 | 4/2006 | Mazooji et al. | |
| 7,059,282 | B2 | 6/2006 | Vorih et al. | |
| 7,308,990 | B2 | 12/2007 | Mazooji et al. | |
| 7,377,758 | B2 | 5/2008 | Sallows et al. | |
| 7,461,762 | B2 | 12/2008 | Law et al. | |
| 7,537,140 | B2 | 5/2009 | Lin | |
| 7,641,077 | B2 | 1/2010 | Law et al. | |
| 7,708,166 | B2 | 5/2010 | Ophardt | |
| 7,815,076 | B2 | 10/2010 | Ophardt | |
| 7,938,297 | B2 | 5/2011 | Law et al. | |
| 8,002,150 | B2 | 8/2011 | Ophardt et al. | |
| 8,047,403 | B2 | 11/2011 | Quinlan et al. | |
| 8,047,404 | B2 | 11/2011 | Quinlan et al. | |
| 8,272,539 | B2 | 9/2012 | Ophardt et al. | |
| 8,336,740 | B1 * | 12/2012 | Daansen | A47K 5/1207 222/181.3 |
| 8,387,834 | B2 * | 3/2013 | Proper | A47K 5/1207 222/181.3 |
| 8,474,664 | B2 | 7/2013 | Ophardt et al. | |
| 8,579,159 | B2 | 11/2013 | Ciavrella | |
| 8,662,356 | B2 | 3/2014 | Padain et al. | |
| 8,814,005 | B2 | 8/2014 | Banks et al. | |
| 8,827,119 | B2 | 9/2014 | Ciavarella et al. | |
| 2002/0139816 | A1 * | 10/2002 | Powling | A47K 5/1204 222/341 |
| 2002/0153389 | A1 | 10/2002 | Creaghan et al. | |
| 2003/0000967 | A1 | 1/2003 | Ehrensperger | |
| 2004/0031816 | A1 | 2/2004 | Schuman | |
| 2004/0206772 | A1 | 10/2004 | Leifheit | |
| 2005/0258192 | A1 | 11/2005 | Matthews et al. | |
| 2005/0284887 | A1 | 12/2005 | Lewis et al. | |
| 2006/0273114 | A1 | 12/2006 | Ophardt | |
| 2007/0007306 | A1 * | 1/2007 | Lin | G01F 11/025 222/321.7 |
| 2008/0272148 | A1 | 11/2008 | Malik et al. | |
| 2009/0200338 | A1 | 8/2009 | Quinlan et al. | |
| 2009/0308894 | A1 | 12/2009 | Ophardt | |
| 2010/0096412 | A1 | 4/2010 | Law | |
| 2011/0079614 | A1 | 4/2011 | Ganzeboom et al. | |
| 2012/0067923 | A1 | 3/2012 | Matthews et al. | |
| 2012/0217267 | A1 | 8/2012 | Bunoz et al. | |
| 2013/0315031 | A1 | 11/2013 | Bunoz et al. | |

FOREIGN PATENT DOCUMENTS

| | | | |
|---|---|---|---|
| EP | 1147818 | A1 | 10/2001 |
| EP | 2080464 | | 7/2009 |
| EP | 2080560 | A1 | 7/2009 |
| EP | 2332453 | A1 | 6/2011 |
| GB | 1269545 | | 4/1972 |
| GB | 2301812 | | 12/1996 |
| GB | 2472235 | | 2/2011 |
| NL | 1023374 | C2 | 8/2003 |
| WO | 2005105320 | | 11/2005 |
| WO | 2011012836 | | 2/2011 |
| WO | 2011157975 | A1 | 12/2011 |

OTHER PUBLICATIONS

International Search Report and Written Opinion from International Application No. PCT/US2013/056106, date of mailing Nov. 7, 2013; 10 pages.

International Search Report and Written Opinion from International Application No. PCT/US2013/067158, date of mailing Apr. 11, 2014; 16 pages.

International Search Report and Written Opinion from International Application No. PCT/US2013/067366, date of mailing Apr. 11, 2014; 18 pages.

International Search Report and Written Opinion from International Application No. PCT/US2013/056964, date of mailing Nov. 7, 2013; 12 pages.

International Search Report and Written Opinion from International Application No. PCT/US2013/056549, date of mailing Jan. 15, 2014; 16 pages.

International Search Report and Written Opinion from International Application No. PCT/US2014/012440, date of mailing Jun. 23, 2014.

International Search Report and Written Opinion from International Application No. PCT/US2014/035072, date of mailing Jul. 23, 2014.

* cited by examiner

PUMPS WITH ANGLED OUTLETS, REFILL UNITS AND DISPENSERS HAVING ANGLED OUTLETS

RELATED APPLICATIONS

This application claims priority to and the benefits of U.S. Provisional Patent Application Ser. No. 61/927,756 filed on Jan. 15, 2014 and entitled "PUMPS WITH ANGLED OUTLETS, REFILL UNITS AND DISPENSERS HAVING ANGLED OUTLETS," which is incorporated herein by reference in its entirety.

TECHNICAL FIELD

The present invention relates generally to liquid dispenser systems and more particularly to pumps with angled outlets, refill units and dispensers having angled outlets.

BACKGROUND OF THE INVENTION

Liquid dispenser systems, such as liquid soap and sanitizer dispensers, provide a user with an amount of liquid upon actuation of the dispenser. Inverted dispensers for soaps and lotions often have an outlet that extends downward and dispenses fluid straight down on a users' hand in a pile. It has been discovered that it is more desirable for the soap or lotion to dispense across the users hand instead of in a pile.

SUMMARY

Exemplary pumps, refill units and dispensers having angled outlets are disclosed herein. An exemplary refill unit for dispensing fluid on a hand includes a container and a pump. The pump includes an angled outlet passage. Fluid flowing out of the angled outlet passage is directed toward the palm of a hand when fluid is dispensed.

Another exemplary refill unit for an inverted dispenser includes a container and a pump. A vertical axis extends through the container and at least a portion of the pump. The pump has an outlet passage and at least a portion of the outlet passage extends at an angle from the vertical axis.

An exemplary pump includes a compressible liquid chamber, a one-way liquid inlet valve and a one-way liquid outlet valve. In addition, the pump includes an angled outlet passage. The angled outlet passage directs fluid out of the pump at an angle of between about 5 and about 35 degrees from a vertical axis.

In this way, a simple and economical apparatus and method of dispensing fluids are provided.

BRIEF DESCRIPTION OF THE DRAWINGS

These and other features and advantages of the present invention will become better understood with regard to the following description and accompanying drawings in which.

DETAILED DESCRIPTION

Figure 1:
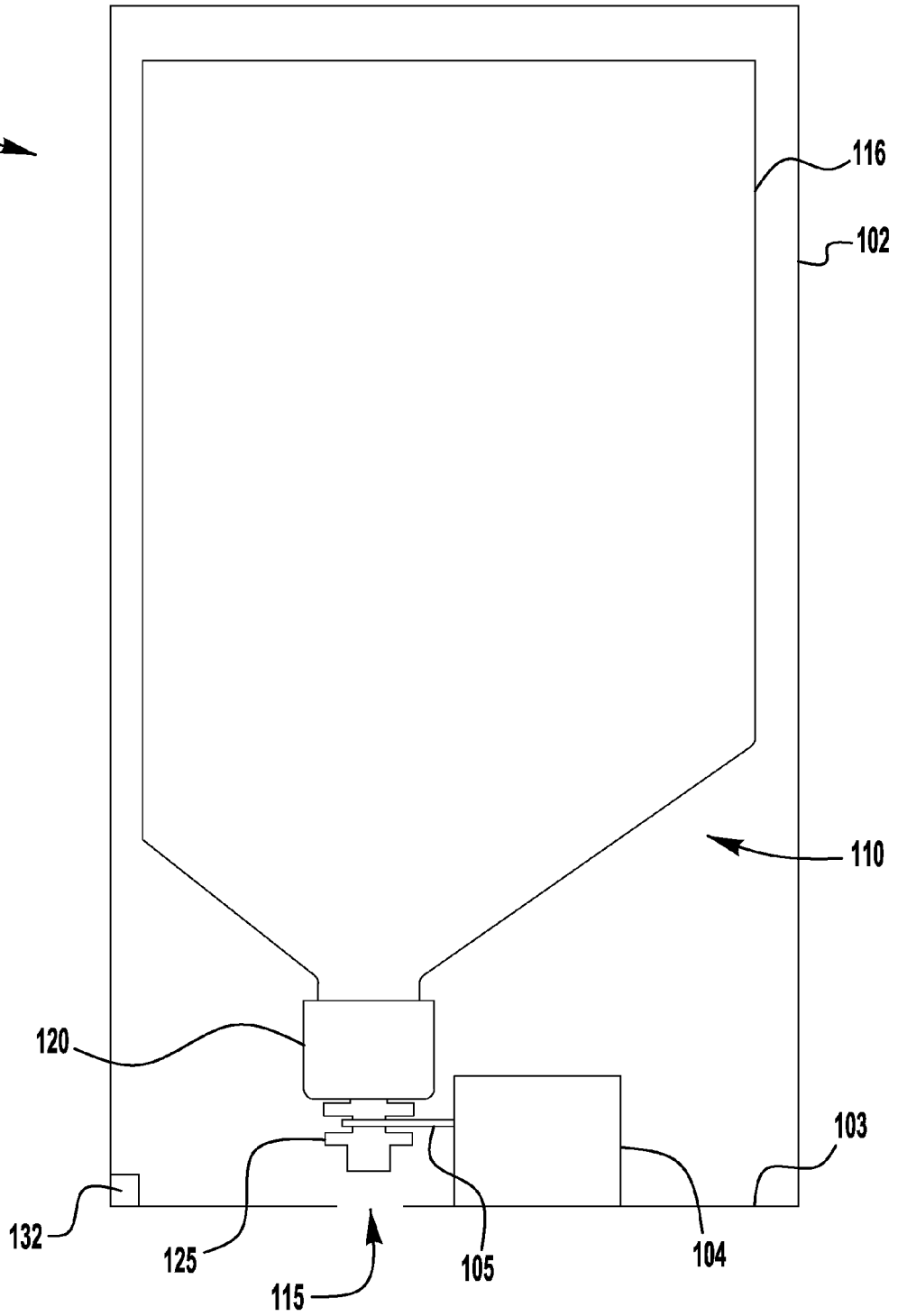
FIG. 1 is a cross-section of an exemplary liquid dispenser for a pump with a vertical dispensing movement and a refill unit.

FIG. 1 illustrates an exemplary embodiment of a dispenser 100. The cross-section of FIG. 1 is taken through the housing 102 to show the pump 120 and container 116. Dispenser 100 includes a disposable refill unit 110. The disposable refill unit 110 includes a container 116 connected to pump 120. The dispenser 100 may be a wall-mounted system, a counter-mounted system, an un-mounted portable system movable from place to place or any other kind of liquid dispenser system. Dispenser 100 may be a foam dispenser or a liquid dispenser.

The container 116 forms a liquid reservoir that contains a supply liquid (which may be foamable) within the disposable refill unit 110. In various embodiments, the contained liquid could be, for example, a soap, a sanitizer, a cleanser, a disinfectant. In the exemplary disposable refill unit 110, the container 116 may be a collapsible container or a non-collapsible container and can be made of thin plastic or like material. The container 116 may advantageously be refillable, replaceable or both refillable and replaceable.

In the event the liquid stored in the container 116 of the installed disposable refill unit 110 runs out, or the installed refill unit 110 otherwise has a failure, the installed refill unit 110 may be removed from the dispenser 100. The empty or failed disposable refill unit 110 may then be replaced with a new disposable refill unit 110.

The housing 102 of the dispenser 100 contains one or more actuating members 104 to activate the pump 120. As used herein, actuator or actuating members or mechanisms include one or more parts that cause the dispenser 100 to move liquid, air or foam. Actuator 104 is generically illustrated because there are many different kinds of pump actuators which may be employed in the foam dispenser 100. The actuator 104 of the dispenser 100 may be any type of actuator such as, for example, a manual lever, a manual pull bar, a manual push bar, a manual rotatable crank, an electrically activated actuator or other means for actuating the pump 120. Electronic actuators may additionally include a sensor 132 for detecting the presence of an object and to provide for a hands-free dispenser system with touchless operation. Various intermediate linkages, such as for example linkage 105, connect the actuator member 104 to the pump 120 within the system housing 102. An aperture 115 is located in bottom plate 103 of housing 102 and allows liquid dispensed from the nozzle 125 of pump 120 to be dispensed to a user.

Figure 2:
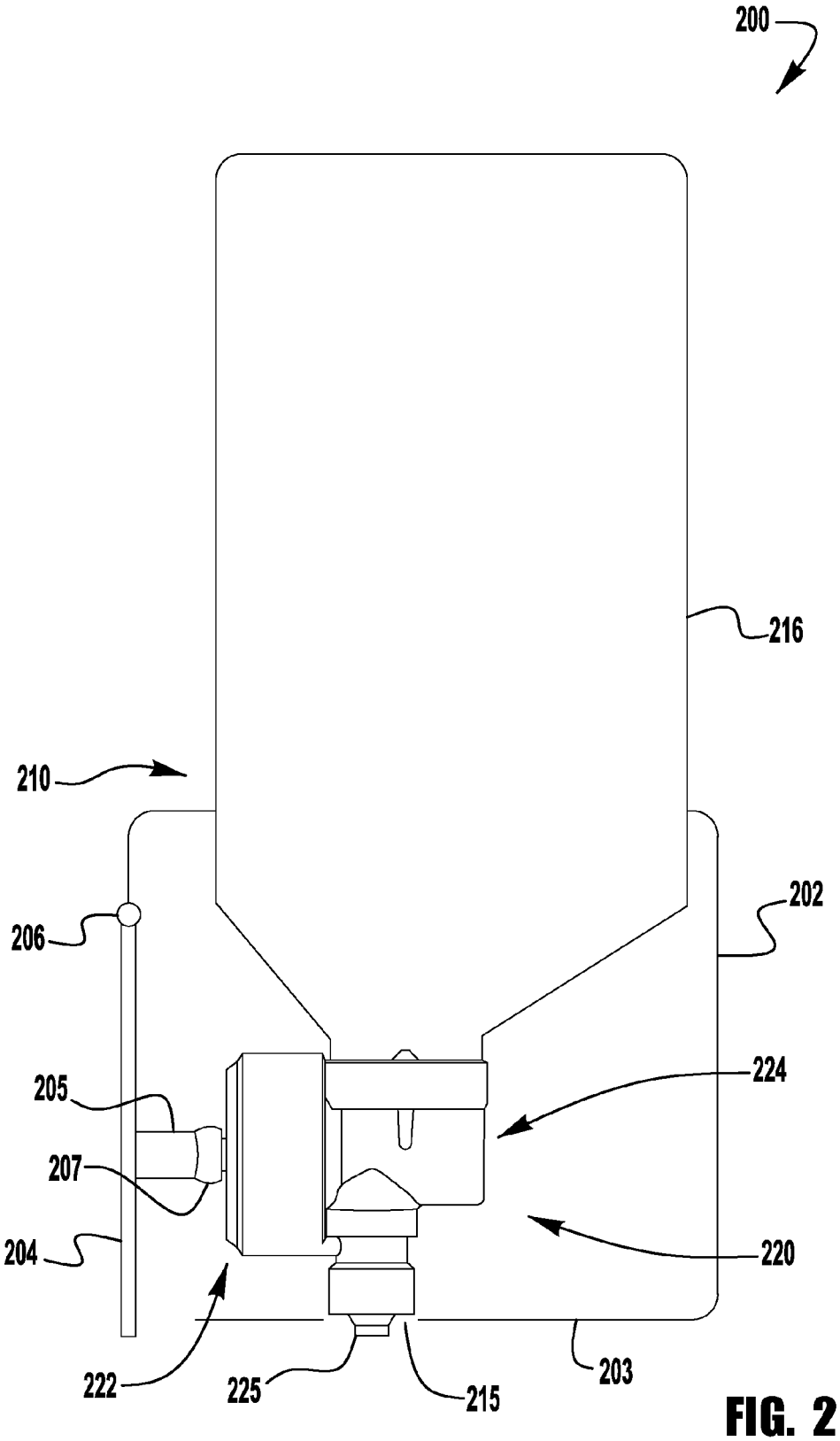
FIG. 2 is a cross-section of an exemplary liquid dispenser for a pump with a horizontal dispensing movement and a refill unit.

FIG. 2 illustrates an exemplary embodiment of a foam dispenser 200. The cross-section of FIG. 2 is taken through the housing 202 to show the foam pump 220 and container 216. Foam dispenser 200 includes a disposable refill unit 210. The disposable refill unit 210 includes a non-collapsible container 216 connected to foam pump 220. The foam dispenser 200 may be a wall-mounted system, a counter-mounted system, an un-mounted portable system movable from place to place or any other kind of foam dispenser system. Some of the exemplary embodiments described herein have foam pumps; that is, they contain a liquid pump and an air compressor. However, the inventive angled outlet system described herein works equally well with a liquid pump that does not include an air compressor.

The container 216 forms a liquid reservoir that contains a supply of a foamable liquid within the disposable refill unit 210. In various embodiments, the contained liquid could be for example a soap, a sanitizer, a cleanser, a disinfectant or some other liquid that may be foamable or not foamable (in the case of a liquid only pump). In the exemplary disposable refill unit 210, the container 216 is a non-collapsible container and can be made of thin plastic or like material. In other embodiments, the container 216 may be formed by a rigid housing member, or have any other suitable configuration for containing the foamable liquid without leaking. The container 216 may advantageously be refillable, replaceable or both refillable and replaceable.

In the event the liquid stored in the container 216 of the installed disposable refill unit 210 runs out, or the installed refill unit 210 otherwise has a failure, the installed refill unit 210 may be removed from the foam dispenser 200. The empty or failed disposable refill unit 210 may then be replaced with a new disposable refill unit 210.

In one embodiment, the housing 202 of the foam dispenser 200 only extends part way around the container 216 thereby exposing at least a portion of the container 216. In such an embodiment, having a container that does not collapse as liquid is pumped out is aesthetically pleasing. The housing 202 of the foam dispenser 200 contains one or more actuating members 204 to activate the pump 220. As used herein, actuator or actuating members or mechanism includes one or more parts that cause the dispenser 200 to move liquid, air or foam. Actuator 204 is generically illustrated because there are many different kinds of pump actuators which may be employed in the foam dispenser 200. The actuator of the foam dispenser 200 may be any type of actuator such as, for example, a manual lever, a manual pull bar, a manual push bar, a manual rotatable crank, an electrically-activated actuator or other means for actuating the foam pump 220 which includes a liquid pump portion 224 and air compressor portion 222. Electronic actuators may additionally include a sensor (not shown) to provide for a hands-free dispenser system with touchless operation. In one embodiment, actuator 204 is connected to housing 202 by a hinge member 206. Various intermediate linkages, such as for example linkage 205, connect the actuator member 204 to the foam pump 220 within the system housing 202. In one embodiment, linkage 205 has a socket 207 that snaps onto a ball (not shown) at the proximate end of piston (not shown). An aperture 215 in bottom plate 203 of housing 202 allows foam dispensed from the nozzle 225 of foam pump 220 to be dispensed to a user.

Figure 3:
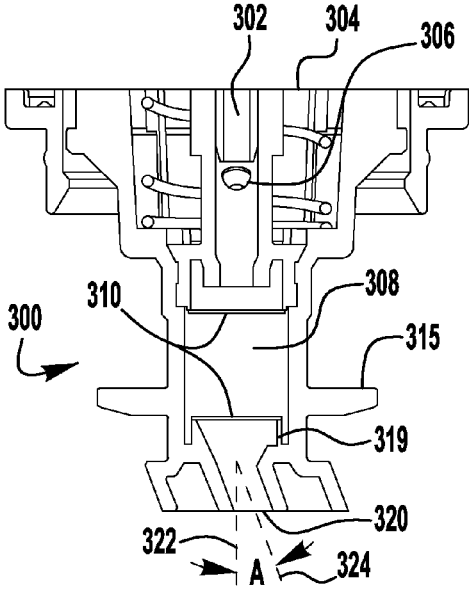
FIG. 3 is partial cross-section of an exemplary embodiment of a vertical foam pump having angled outlet.

FIG. 3 is a partial cross-section of an exemplary embodiment of a foam pump 300. Foam pump 300 uses a vertical upward and downward movement to dispense fluid. Foam pump 300 may be any vertical movement foam pump, such as for example, the foam pump disclosed in U.S. Pat. No. 8,272,539, filed on Dec. 3, 2008 and entitled Angled Slot Foam Dispenser, which is incorporated herein by reference in its entirety, and a pull foam pump disclosed in U.S. patent application Ser. No. 13/747,881 filed on Jan. 23, 2013 and entitled Pull Pumps, Refill Units, And Dispensers For Pull Pumps, which is also incorporated herein by reference. The workings of these foam pumps may be the same as the inventive pumps disclosed herein with the exception that outlet 320 is an angled outlet that provides a foam output that covers a larger area on a user's hands then the prior art outlets.

Foam pump 300 includes an actuator engagement member 315 that engages an actuator (not shown) of a dispenser (not shown). In addition, foam pump 300 includes a liquid inlet passage 302. Foam pump 300 also includes a compressible air chamber 304 and an air inlet aperture 306 leading from the compressible air chamber to the liquid inlet passage 302. Foam pump 300 includes a foaming chamber 308 that includes a pair of screens 310. In this exemplary embodiment, located below foaming chamber 308 is a funnel shaped passage 319. An angled outlet 320 is located at the end of pump 300. A centerline 322 of pump 300 is illustrated in FIG. 3. Centerline 324 is the center of angled outlet 320. In some embodiments, the angle A between centerline 322 and the centerline 324 of angled outlet 320 is between about 5 degrees and about 30 degrees. The angled outlet 320 allows foam to be dispensed in a larger area on a user's hands then prior art foam dispensers. In some embodiments, the length of angled outlet 320 is greater than about ⅛", in some embodiments the angled outlet is greater than about ¼", in some embodiments, the angled outlet is less than about 1" and in some embodiments the length is less than about 2".

Figure 4:
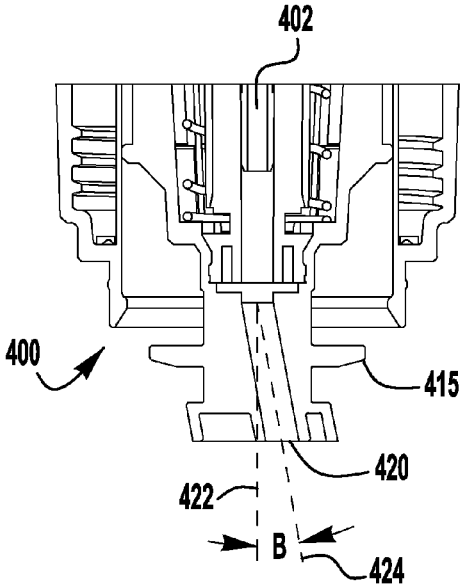
FIG. 4 is partial cross-section of an exemplary embodiment of a vertical liquid pump having angled outlet.

FIG. 4 is a partial cross-section of an exemplary embodiment of a liquid pump 400. Liquid pump 400 uses a vertical upward and downward movement to dispense fluid. Liquid pump 400 may be any vertical movement liquid pump, such as for example, the liquid pump disclosed in U.S. Pat. No. 8,002,150 filed on Jul. 30, 2007 and entitled Split Engagement Flange For Soap Dispenser Pump Piston, which is incorporated herein by reference in its entirety. In addition, the foam pumps disclosed above may be modified to remove the air pump portion to become liquid pumps. The workings of these liquid pumps may be the same as the inventive pumps disclosed herein, with the exception that outlet 420 is an angled outlet that provides a liquid output that covers a larger area then the prior art outlets. Liquid pump 400 includes an actuator engagement member 415 that engages the actuator (not shown) of a dispenser (not shown). Liquid pump 400 includes a liquid inlet passage 402. An angled outlet 420 is located at the end of pump 400. The length of liquid outlet 420 is longer than the length of the liquid outlet illustrated in foam pump 300, however, the liquid outlet 420 may be any length as long as it directs the liquid out at an angle so that the area of the output on the hand is larger than the area of an outlet that dispenses straight vertically. In some embodiments, the length of angled outlet 420 is greater than about ⅛", in some embodiments the angled outlet 420 is greater than about ¼", in some embodiments, the angled outlet 420 is less than about 1" and in some embodiments the length is less than about 2". A centerline 422 of pump 400 is illustrated in FIG. 4. Centerline 424 is the center of angled outlet 420. In some embodiments, the angle B between centerline 422 and the centerline 424 of angled outlet 420 is between about 5 degrees and about 30 degrees. The angled outlet 420 allows liquid to be dispensed in a larger area then prior art liquid dispensers.

Figure 5:
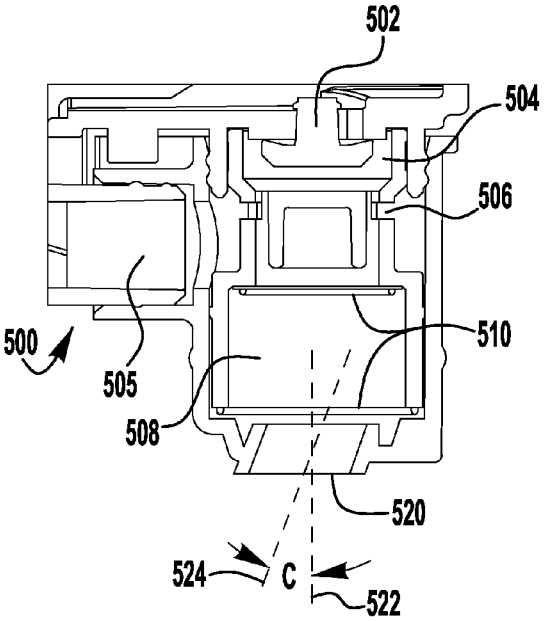
FIG. 5 is partial cross-section of an exemplary embodiment of a horizontal foam pump having angled outlet.

FIG. 5 is a partial cross-section of an exemplary embodiment of a foam pump 500. Foam pump 500 uses a horizontal movement to dispense fluid. Foam pump 500 may be any horizontal movement foam pump, such as for example, the foam pump disclosed in U.S. patent application Ser. No. 13/792,115 filed on Mar. 10, 2013 and entitled Horizontal Pumps, Refill Units And Foam Dispensers which is incorporated herein by reference in its entirety, and a horizontal foam pump disclosed in U.S. patent application Ser. No. 13/747,909 filed on Jan. 23, 2013 and entitled Pumps With Container Pumps, which is also incorporated by reference in its entirety. The workings of these foam pumps may be the same as the inventive pumps disclosed herein, with the exception that outlet 520 is an angled outlet that provides a foam output that covers a larger area then the prior art outlets. Foam pump 500 includes a liquid outlet valve 502, and a liquid passage 504. In addition, foam pump 500 includes an air passage 505 from a compressible air chamber (not shown) and an air inlet aperture 506 leading to the liquid inlet passage 504. Air and liquid mix together in the passage 504 and pass through foam screens 510. An angled outlet 520 is located at the end of pump 500. A centerline 522 of pump 500 is illustrated in FIG. 5. Centerline 524 is the center of angled outlet 520. In some embodiments, the angle C between centerline 522 and the centerline 524 of angled outlet 520 is between about 5 degrees and about 30 degrees. The angled outlet 520 allows foam to be dispensed in a larger area then prior art foam dispensers. In some embodiments, the length of angled outlet 520 is greater than about ⅛", in some embodiments the angled outlet 520 is greater than about ¼", in some embodiments, the angled outlet is less than about 1" and in some embodiments the length is less than about 2".

Figure 6:
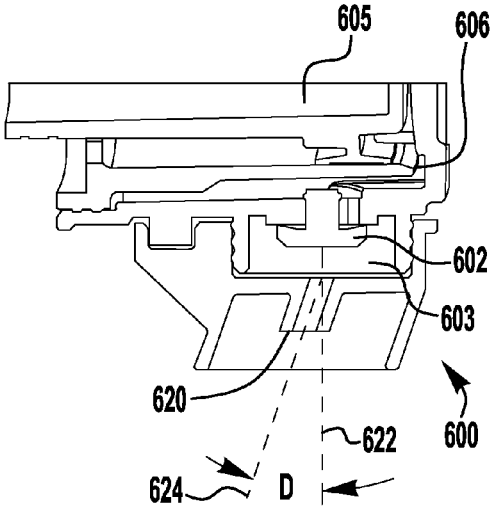
FIG. 6 is partial cross-section of an exemplary embodiment of a horizontal liquid pump having angled outlet.

FIG. 6 is a partial cross-section of an exemplary embodiment of a liquid pump 600. Liquid pump 600 uses a horizontal movement to dispense fluid. Liquid pump 600 may be any vertical movement liquid pump, such as for example, the liquid pump portion of the horizontal foam pumps incorporated by reference above without the air compressor portion, the air passages and the foaming cartridges or screens. The workings of these liquid pumps may be the same as the inventive pumps disclosed herein with the exception that outlet 620 is an angled outlet that provides a liquid output that covers a larger area then the prior art outlets with the same amount of fluids. Liquid pump 600 also includes a liquid piston 605, which is partially shown. Liquid pump 600 includes a liquid outlet valve 602 and a liquid passage 603. An angled outlet 620 is located at the end of pump 600. The length of liquid outlet 620 may be any length as long as it directs the liquid out at an angle so that the area of the output on the hand is larger than the area of an outlet that dispenses straight vertically. In some embodiments, the length of angled outlet 620 is greater than about ⅛", in some embodiments the angled outlet 620 is greater than about ¼", in some embodiments, the angled outlet 620 is less than about 1" and in some embodiments the length is less than about 2". A centerline 622 of pump 600 is illustrated in FIG. 6. Centerline 624 is the center of angled outlet 620. In some embodiments, the angle D between centerline 622 and the centerline 624 of angled outlet 620 is between about 5 degrees and about 30 degrees. The angled outlet 620 allows foam to be dispensed in a larger area then prior art foam dispensers.

In addition, the containers and or pumps may include one or more alignment members, not shown, to cause the refill unit or pumps to be installed in a dispenser to cause the outlet to angle toward a user's palm. The alignment members may be a key, a ridge, a groove, a tab or the like.

While the present invention has been illustrated by the description of embodiments thereof and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus and illustrative examples shown and described. Accordingly, departures may be made from such details without departing from the spirit or scope of the applicant's general inventive concept.

We claim:

1. A refill unit for a dispenser fluid on a hand comprising:
a container;
a pump;
the pump having an inlet passage and an outlet passage;
wherein a vertical axis extends through the inlet passage;
wherein the outlet passage includes a first portion and an angled portion;
wherein the vertical axis extends through the first portion, and the angled portion extends at an angle from the vertical axis;
wherein at least a portion of the outlet passage is located at a lowest point of the pump;
wherein fluid flowing out of the outlet passage is directed at a non-vertical angle across the palm of a hand when fluid is dispensed.

2. The refill unit of claim 1 wherein the pump is a foam pump, and wherein the outlet passage is located downstream of a foam generator.

3. The refill unit of claim 1 wherein the angle of the angled portion of the outlet passage is about 5 degrees to about 30 degrees from the vertical axis.

4. The refill unit of claim 1 wherein the length of the outlet passage is greater than about ⅛".

5. The refill unit of claim 1 wherein the length of the outlet passage is greater than about ¼".

6. The refill unit of claim 1 wherein the length of the outlet passage is less than about 1".

7. The refill unit of claim 1 wherein the length of the outlet passage is less than about 2".

8. The refill unit of claim 1 further comprising an alignment member for aligning the angled portion of the outlet passage toward the palm of a hand when the refill unit is installed in a dispenser.

9. The refill unit of claim 1 wherein the outlet passage moves upward and downward during operation of the pump.

10. The refill unit of claim 1 wherein the outlet passage is stationary during operation of the pump.

11. The refill unit of claim 1 further comprising a liquid piston wherein the angled portion of the outlet passage is not parallel or perpendicular to the movement of the liquid piston.

12. A refill unit comprising:
a container;
a pump;
the pump having an outlet passage;
wherein at least a portion of the outlet passage is located at a lowest point of the pump;
wherein fluid enters the outlet passage along a vertical axis and exits the outlet passage along an axis that extends at an angle from the vertical axis.

13. The refill unit of claim 12 wherein the pump is a foam pump, and the outlet passage is located downstream of a foam generator.

14. The refill unit of claim 12 wherein the angle of the axis along which the fluid exits the outlet passage is about 5 degrees to about 30 degrees from the vertical axis.

15. The refill unit of claim 12 wherein the length of the outlet passage is greater than about ⅛".

16. The refill unit of claim 12 wherein the length of the outlet passage is greater than about ¼".

17. The refill unit of claim 12 wherein the length of the outlet passage is less than about 1".

* * * * *